US008448409B2

(12) United States Patent
Xie

(10) Patent No.: US 8,448,409 B2
(45) Date of Patent: May 28, 2013

(54) METHOD AND APPARATUS OF INSTALLING DECORATIVE PIECES

(76) Inventor: Alex Xie, West Windsor, NJ (US)

( * ) Notice: Subject to any disclaimer, the term of this patent is extended or adjusted under 35 U.S.C. 154(b) by 226 days.

(21) Appl. No.: 13/042,070

(22) Filed: Mar. 7, 2011

(65) Prior Publication Data

US 2012/0227344 A1 Sep. 13, 2012

(51) Int. Cl.
*E04G 23/00* (2006.01)

(52) U.S. Cl.
USPC ..... 52/747.11; 52/747.12; 52/749.11; 52/745.21

(58) Field of Classification Search
USPC ..... 52/311.2, 314, 315, 384, 388, 390, 52/391, 747.11, 747.12, 749.11
See application file for complete search history.

(56) References Cited

U.S. PATENT DOCUMENTS 5,445,696 A * 8/1995 Krawczyk ..... 156/230
7,310,973 B2 12/2007 Xie ..... 65/121
7,493,732 B2 * 2/2009 Brailsford et al. ..... 52/311.1
2006/0107610 A1 * 5/2006 Boserio ..... 52/315
2009/0314421 A1 12/2009 Xie ..... 156/230
2010/0212256 A1 * 8/2010 Llorens Selles ..... 52/747.11

* cited by examiner

*Primary Examiner* — William Gilbert
*Assistant Examiner* — Patrick Maestri
(74) *Attorney, Agent, or Firm* — Walter J. Tencza, Jr.

(57) ABSTRACT

A plurality of decorative pieces, such as chips, stones, or tiles, are temporarily attached to a rigid film by a releasable adhesive. First and second tile sections are fixed to a floor or subfloor surface to create a gap between the first and second tile sections. A tool is provided having a plurality of teeth which are configured so that they can be inserted in the gap between the first and second tile sections. The tool may also include two shoulder or wing portions which engage and overlap portions of the first and second tile sections and which thereby prevent the plurality of teeth from penetrating farther than a certain distance into the gap. The gap may be formed by gluing the first tile section and the second tile section to the floor or subfloor surface with a first glue. The method may further include gluing the plurality of decorative pieces, with a second glue, inside the gap, and then peeling off the rigid film from the plurality of decorative pieces.

16 Claims, 7 Drawing Sheets

METHOD AND APPARATUS OF INSTALLING DECORATIVE PIECES

FIELD OF THE INVENTION

This invention relates to improved methods and apparatus concerning installing decorative pieces, such as mosaic tiles or chips.

BACKGROUND OF THE INVENTION

There are various devices known in the prior art for installing decorative pieces, such as tiles or chips.

SUMMARY OF THE INVENTION

In at least one embodiment, an apparatus is provided which includes a rigid film and a plurality of decorative pieces. Each of the plurality of decorative pieces may be a chip, a tile, a stone, or other decorative piece. The plurality of decorative pieces may be temporarily attached to the rigid film by a releasable adhesive such as a pressure sensitive adhesive. The apparatus may further include first and second tile sections, wherein the first and second tile sections can be fixed to a floor surface (which may include a subfloor surface) to create a gap between the first and second tile sections. The apparatus may be further comprised of a tool having a plurality of teeth which are configured so that they can be inserted in the gap between the first and second tile sections. The tool may also include two shoulder or wing portions which engage and overlap portions of the first and second tile sections and which thereby prevent the plurality of teeth from penetrating farther than a certain distance into the gap.

At least one embodiment of the present application provides a method including configuring a strip of rigid film so that the strip of rigid film has a width larger than a gap between a first tile section and a second tile section which have been laid out on a floor or wall surface. The method may also include temporarily attaching a plurality of decorative pieces to the strip of film by a releasable adhesive. Each of the plurality of decorative pieces may have a width which is smaller than the gap between the first tile section and the second tile section.

In at least one embodiment, the gap between the first tile section and the second tile section is formed by gluing the first tile section and the second tile section to the floor or wall surface with a first glue. The method may further include gluing the plurality of tiles, with a second glue, inside the gap between the first tile section and the second tile section. After gluing the first tile section and the second tile section to the floor or wall surface, the method may include allowing a first glue, used to glue the first tile section and the second tile section to the floor surface to dry before the step of gluing the plurality of decorative pieces inside the gap between the first tile section and the second tile section.

The first tile section may have a height, and the second tile section may have a height. Each of the plurality of tiles may have a height. The height of each of the plurality of decorative pieces is less than the height of the first tile section and less than the height of the second tile section. The plurality of decorative pieces may be glued inside of the gap between the first tile section and the second tile section so that a top surface of each of the plurality of decorative pieces is substantially level with a top surface of the first tile section and a top surface of a second tile section, and wherein the height of the first tile section, the height of the second tile section, and the height of each of the plurality of decorative pieces is perpendicular or substantially perpendicular to the top surfaces of the first and second tile sections and the top surface of each of the plurality of decorative pieces.

The method may also include peeling off the rigid film from the plurality of decorative pieces after the second glue has dried, so that the plurality of decorative pieces are fixed in the gap and are no longer attached to the rigid film. The first glue and the second glue may be the same type of glue. The step of gluing the plurality of decorative pieces, with a second glue, inside the gap between the first tile section and the second tile section, may include applying the second glue inside the gap, and then raking the second glue with a plurality of teeth of a tool. The tool may have two shoulder portions which engage portions of the first and second tile sections and which thereby prevent the teeth from penetrating farther than a certain distance into the gap.

DETAILED DESCRIPTION OF THE DRAWINGS

Figure 1A:
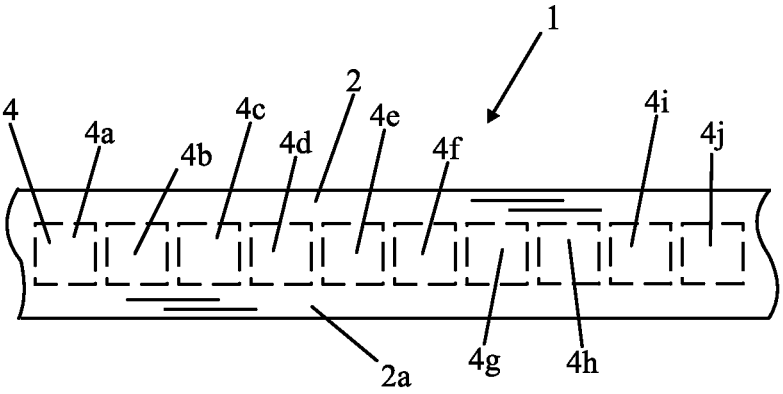
FIG. 1A is a top view of a film with a plurality of chips or tiles attached to an underside of the film, as shown by dashed line boxes.
Figure 1B:
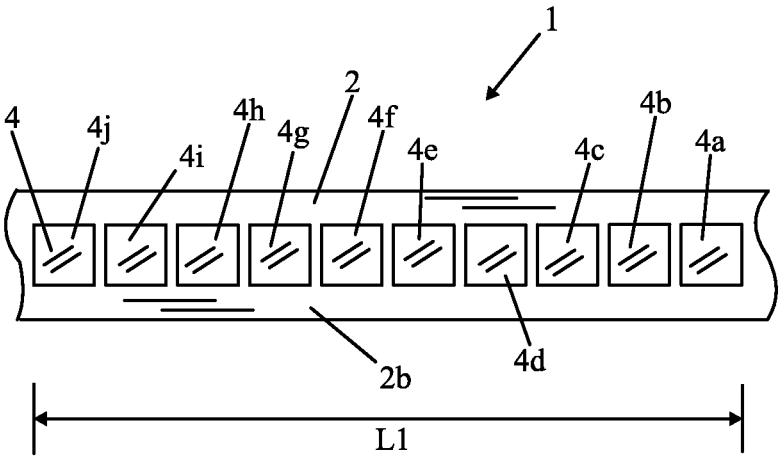
FIG. 1B is a bottom view of the film of FIG. 1A, with the plurality of chips or tiles shown attached to the film.

FIG. 1A is a top view of a film 2 with a plurality of chips or tiles 4 attached to an underside 2*b* (shown in FIG. 1B) of the film 2, as shown by dashed line boxes for chips or tiles 4. The chips or tiles 4 include chips or tiles 4*a*, 4*b*, 4*c*, 4*d*, 4*e*, 4*f*, 4*g*, 4*h*, 4*i*, and 4*j*. FIG. 1B is a bottom view of the film 2 of FIG. 1A, with the plurality of chips or tiles 4 shown attached to the side 2*b* of the film 2.

The film 2 may be a rigid plastic film. In at least one embodiment, the film 2 is rigid enough so that it will not sag when mosaic chips or tiles are attached to the side 2*b* of the film 2, and when the film 2 is supported by surrounding tile or stone, such as surrounding stone or tile section 6, and surrounding stone or tile section 8 as shown in FIG. 3.

Figure 2:
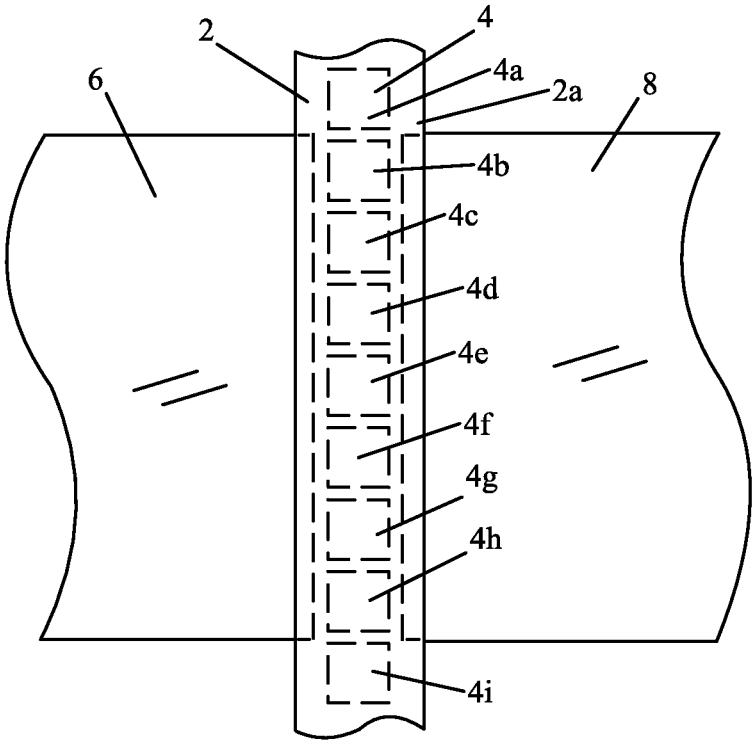
FIG. 2 is a top view of the film of FIG. 1A, with the plurality of chips or tiles attached to an underside of the film, as shown by dashed line boxes, and with the film placed over portions of two surrounding stone or tile sections.

FIG. 2 is a top view of the film 2 of FIG. 1A, with the plurality of chips or tiles 4 attached to the underside 2*b* of the film 2, as shown by dashed line boxes for the chips or tiles 4, and with the film 2 placed over portions 6*a* and 8*a* (shown in FIG. 3) of the two surrounding stone or tile sections 6 and 8, respectively.

Figure 3:
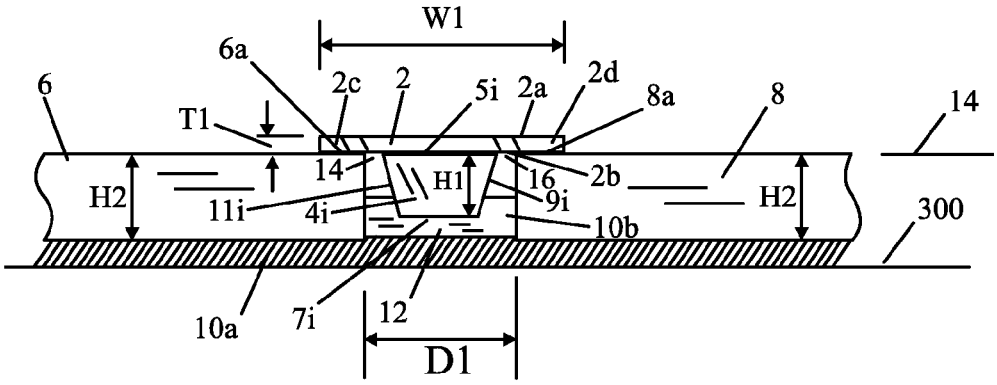
FIG. 3 is a front view of the film of FIG. 1A attached to the plurality of chips or tiles, placed over portions of the two surrounding stone or tile sections of FIG. 2.

FIG. 3 is a front view of the film 2 of FIG. 1A attached to the plurality of chips or tiles 4, placed over the portions 6*a* and 8*a* of the two surrounding stone or tile sections of 6 and 8, respectively.

Figure 4:
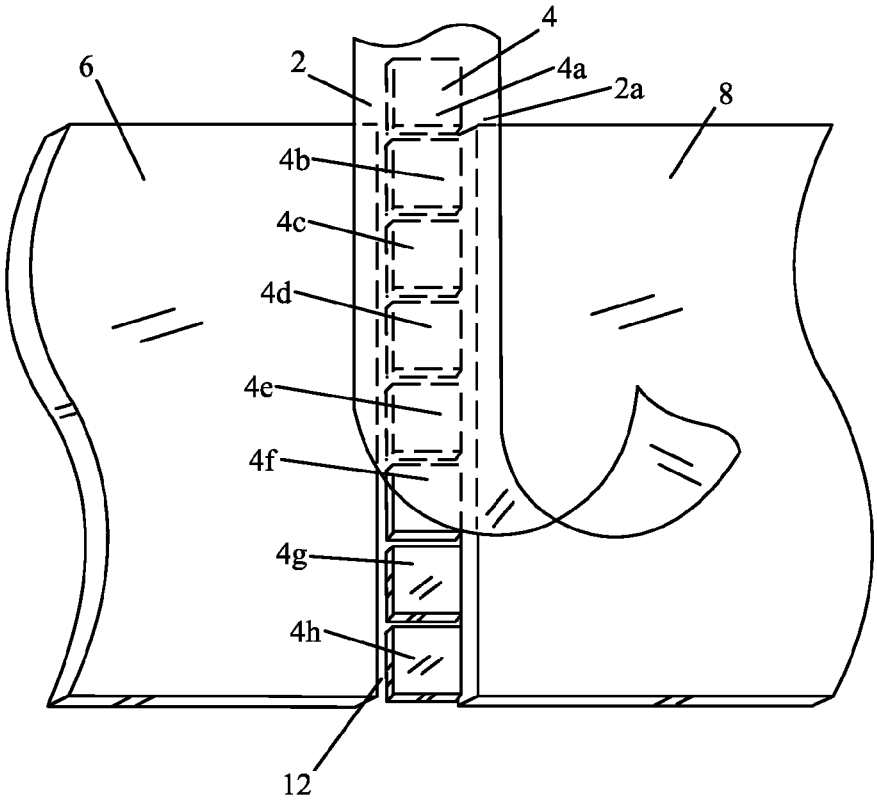
FIG. 4 is a top perspective view of the two surrounding stone or tile sections of FIG. 2, with some of the plurality of chips or tiles shown by dashed lines to show that they are covered by the film of FIG. 1A, and with some of the plurality of chips or tiles shown with solid lines to show that they are no longer covered by the film of FIG. 1A, and with the film shown partially peeled off of the plurality of chip or tiles.

FIG. 4 is a top perspective view of the two surrounding stone or tile sections 6 and 8 with some of the plurality of chips or tiles 4 shown by dashed lines to show that they are covered by the film 2, and with some of the plurality of chips or tiles 4 shown with solid lines to show that they are no longer covered by the film 2, and with the film 2 shown partially peeled off of the plurality of chip or tiles.

The plurality of chips or tiles 4 are adhered to the underside 2*b* of the film 2 by a pressure sensitive adhesive.

The film 2 may have a length of L1, shown in FIG. 1B, which may be the length from the beginning of the chip 4*j* to the end of the chip 4*a*. The film 2 may have a width, W1, and a thickness T1 shown in FIG. 3. The length L1 may be any length by typically is substantially greater than the width, W1. The width W1, may be any length but is typically substantially greater than the thickness T1. The width W1 should be greater than the distance D1 of a gap 12 between the surrounding stone or tile sections 6 and 8, shown in FIG. 3, so that the film 2, which is typically a rigid plastic film, is supported on sections 6 and 8, so the chips or tiles 4 do not sink into adhesive 10.

The plurality of chips or tiles 4 are typically arranged in linear format on the film 2 and are attached with a pressure sensitive adhesive.

Each of the plurality of decorative pieces (which may be chips or tiles) 4 may have a height H1, shown in FIG. 3, while each of the tile or stone sections 6 and 8 may have a height H2 which may be greater than H1. One or more embodiments of the present invention allow the top surface of portions 6*a* and 8*a* to be made level with the top surface 5*i* of decorative piece 4*i* and other decorative pieces of 4, such as level with line 14.

Tile or stone sections 6 and 8 may be glued by first glue 10*a* to floor or subfloor or wall surface 300 shown in FIG. 3.

In operation, tile glue 10*b* is placed in the gap 12 as shown in FIG. 3. Next a special winged tool, such as tool 200 shown in FIGS. 6, 7, 8A, and 8B, may be used to evenly distribute the tile glue 10*b* within the gap 12. The tool 200 should have an overall teeth width W3 which is slightly less than the distance D1 of the gap 12. The use of tool 200, in at least one embodiment, ensures the right amount (or right level) of the tile glue 10*b* in the gap 12 to achieve a maximum bond with bottom and side surfaces of each of tiles or chips 4 and at the same time without excess glue 10*b* overflowing through grout joints 14, 16 shown in FIG. 3, and onto top surface 5*i* of tile 4*i* or similar or identical top surfaces of all of the other tiles or chips of chips 4.

Next, the decorative trim (i.e. chips or tiles 4) is laid into the gap 12 so that the chips 4 are inserted at least partially into the tile glue 10*b*, as shown by FIG. 3. Although FIG. 3 only shows tile 4*i*, the tiles 4*a*, 4*b*, 4*c*, 4*d*, 4*e*, 4*f*, 4*g*, and 4*h* would also be laid into the gap 12, similar to tile 4*i*, so that they are inserted into the glue 10*b*, but typically not all the way into the glue 10*b* since they are held up and/or supported by film 2 resting on portions 6*a* and 8*a* of stone or tile sections 6 and 8, respectively. Two sides or ends 2*c* and 2*d*, shown in FIG. 3 and FIG. 4, of the film 2 resting on the portions 6*a* and 8*a* of the stone or tile sections 6 and 8, effectively bridge the gap 12, and prevent the chips 4 from sinking all the way into the glue 10*b*, while using a flat trowel to tap along top surface 2*a* of the film 2 to press decorative trim (i.e. chips 4) into the gap 12. This allows the chips or tile 4 to maintain the same surface level, as the stone or tile sections 6 and 8, regardless of the thickness of the adjacent tile or stone sections. For example, as shown in FIG. 3, chip 4*i* has a surface 5*i*, which when the film 2 is removed, is at the same surface level 14 as a surface level of the portions 6*a* and 8*a*, of the stone or tile sections 6 and 8, respectively.

After the tile glue 10 has dried, the rigid film 2 is peeled off from the chips 4. The normal grouting process can be done for an entire surface, which may include gaps between the tiles or chips 4 and the stone sections 6 and 8, and the surfaces of the chips 4 and stone sections 6 and 8 (such as surfaces 5*i*, and surfaces of portions 6*a* and 8*a*). The film 2, in at least one embodiment in a rigid plastic form, allows mosaic chips, such as chips 4, to be installed in a gap 12, to create flush surfaces (for surfaces 6*a*, 8*a* and 5*i*) regardless of the thickness of the tile or stone sections 6 and 8.

In at least one embodiment of the present invention, the following method is also provided. The method will described at least partially with reference to a flow chart 100 shown in FIG. 5. At step 102 the surrounding stone or sections 6 and 8 shown in FIG. 3, in at least one embodiment, are set into tile glue 10*a*, while the glue 10*a* is still fresh, i.e. not dried or set. The sections 6 and 8 may be called field tiles, and any similar sections or any other field tiles typically would also be set into the tile glue 10*a*. When laying out the installation of the sections 6 and 8 and other field tiles, the installer should be sure to allow sufficient space, such as gap 12 between sections 6 and 8 in FIG. 3, to accommodate the chips 4 but not wider than the width, W1, of the film 2 shown in FIG. 3, so that sections 6 and 8 can support the film 2. In an least one embodiment, for any non beveled edge field tile for sections 6 and 8, a trim installation spacer can be used to provide an appropriate gap 12 between sections 6 and 8. In at least one embodiment, for any beveled edge field tile for sections 6 and 8, a different spacer may be used to adjust the distance D1 of the gap 12 between sections 6 and 8.

In at least one embodiment, sufficient time is then allowed for sections 6 and 8 and other field tiles to fully set before beginning decorative strip (i.e. chips or tiles 4 using film 2) installation, such as six to forty-eight hours depend on the type of the tile glue used.

Figure 5:
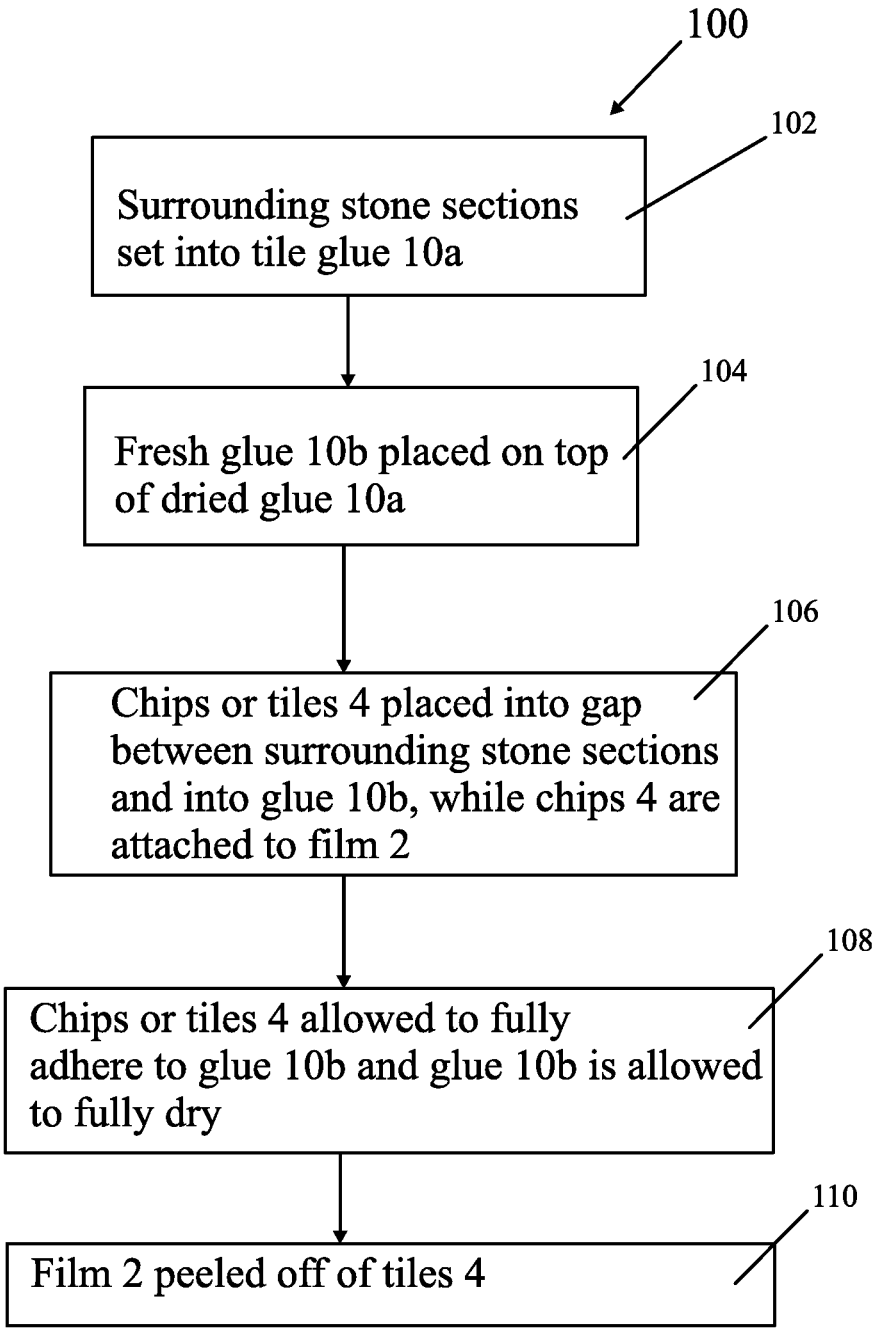
FIG. 5 shows a flow chart of a method in accordance with an embodiment of the present invention.

Next, at step 104, shown in FIG. 5, a margin trowel or flat side of notched trowel can be used to place fresh (i.e. non-dried) glue 10*b* on top of dried or set glue 10*a*, in gap 12. The fresh glue 10*b* is used to set chips 4 in the gap 12.

A special winged leveling tool may be provided to evenly distribute the tile glue 10*b* within the gap 12. This will insure that an adhesive agent of the tile glue 10*b* is properly positioned to achieve a maximum bond with bottom and side surfaces of each of tiles or chips 4, such as onto bottom surface 7*i*, side surface 9*i*, and side surface 11*i* of tile or chip 4*i*, and similar or identical surfaces of all of the other chips or tiles of chips or tiles 4, without excess glue 10*b* overflowing onto top surface 5*i* of tile 4*i* or similar or identical top surfaces of all of the other tiles or chips of chips 4 and without over filling grout joint or gap 12.

Next, at step 106 shown in FIG. 5, the chips or tiles 4 are placed into the gap 12 and into the glue 10*b*, while attached to the film 2, and so that the film 2 overlaps portions 6*a* and 8*a* of the stone sections 6 and 8, respectively, as shown by FIGS. 2-3.

In at least one embodiment, the installer should carefully presses the top surface 2*a* to carefully push the chips 4 into the glue 10*b*, by using a clean smooth flat trowel to tap along top surface 2*a* of film 2. When tapping the top surface 2*a* of the film 2, in at least one embodiment, an installer should tap the large area of the side of the tile at the same time.

Next, at step 108 shown in FIG. 5, an installer allows the tiles or chips 4 to fully adhere to mortar or glue 10*b* and allows the glue 10*b* to fully dry. Next, at step 110 shown in FIG. 5, an installer would lowly peel off the film 2 so that it is no longer connected to the chips or tiles 4. Spaces or gaps, such as gaps 14 and 16 shown in FIG. 3, between the chips 4 and the stone or tile sections 6 and 8, can be covered after removal of the film 2, by grout.

Although the chips 4 are shown in as a line of chips in FIG. 1A, in some embodiments, the chips 4 can be provided as a matrix of a plurality of rows and columns attached to the film 2. In such a case, in a view similar to FIG. 3, one would see a plurality of chips or tiles, similar to chip 4*i*, inserted into the gap 12, due to the plurality or rows or columns of chips.

In at least one embodiment, the film 2 is typically clear or transparent so an installer can see the tiles or chips 4 and tile glue 10*b* through the film 2. The film 2 with chips 4 attached (which may be called a type of decorative trim), can be replaced by other formats, such as more rows of chips in different arrangement, or with chips 4 in different shapes or patterns. Each of the chips 4 (or decorative materials), may be made substantially or entirely of one or more of various materials such as glass chips, stone chips, ceramic chips, metal chips, etc.

Figure 6:
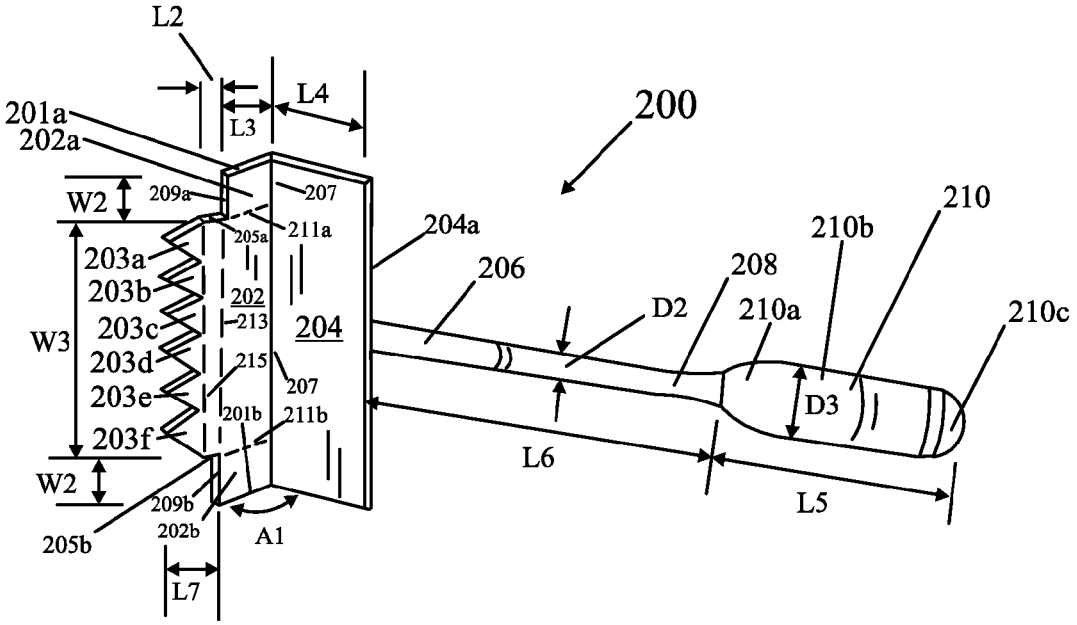
FIG. 6 shows a right side, bottom, rear perspective view of a tool in accordance with an embodiment of the present invention.
Figure 7:
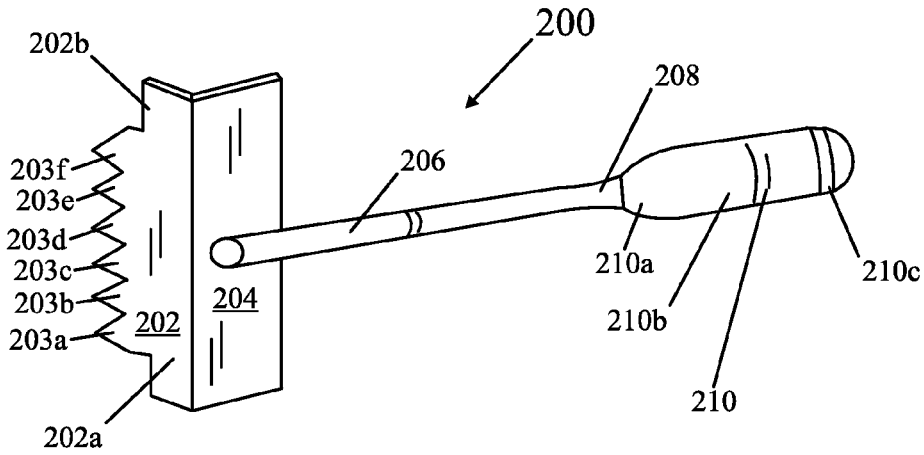
FIG. 7 shows a left side, top, front perspective view of the tool of FIG. 6.

FIG. 6 shows a right side, bottom, rear perspective view of a tool 200 in accordance with an embodiment of the present invention. FIG. 7 shows a left side, top, front perspective view of the tool 200. Referring to FIGS. 6-7, the tool 200 includes a plate 202 and a plate 204. The plates 202 and 204 may be substantially or entirely flat. The plates 202 and 204 may be at an angle of A1, which may be an angle in the range of 90 to 110 degrees, in some embodiments, or may be another angle in other embodiments. The plate 202 may have a teeth 203*a*, 203*b*, 203*c*, 203*d*, 203*e*, and 203*f*. The plate 204 may be fixed to a pole, post, or member 206. The pole, post, or member 206 may be integrated with or fixed to a tapered member 208, which may be fixed to a handle 210. The handle 210 may include a tapered portion 210*a*, a solid cylindrical portion 210*b*, and a tapered portion 210*c*.

The plate 202 may include a step or protruding section bordered by straight ends or edges 205*a*, and 205*b*. The plate 202 may include substantially flat or entirely flat portion 202*a* which may be described as being bordered or defined by end 201*a*, junction 207, end 209*a*, and dashed line 211*a*. Dashed line 211*a* is shown for descriptive purposes and typically does not actually appear on the tool 200. The plate 202 may include substantially flat or entirely flat portion 202*b* which may be described as being bordered or defined by end 201*b*, junction 207, end 209*b*, and dashed line 211*b*. Dashed line 211*b* is shown for descriptive purposes and typically does not actually appear on the tool 200.

The plate 202 may include a substantially flat or entirely flat body portion defined or bordered by junction 207, dashes lines 211*a* and 211*b*, and dashed lines 213. Dashed lines 213 are used for descriptive purposes and typically do not actually appear on the tool 200. The plate 202 may have a substantially flat step or protruding section defined or bordered by dashed lines 213, dashed lines 215, and ends 205*a*, and 205*b*. The dashed lines 215 are used for descriptive purposes and do not typically actually appear on the tool 200.

The plate 202 may include a plurality of teeth 203*a-f*, which protrude out from the plate 202 and out from the protruding section defined by or bordered by dashed lines 213, dashed lines 215, and ends 205 and 205*b*. Each of the teeth 203*a-f* may be triangular in shape, or may be some other shape in other embodiments, such as square teeth.

The plate 204 may be substantially rectangular. The plates 202 and 204 may be made of metal such as steel, iron, other other metal, or a hard plastic material.

Referring to FIG. 6, the protruding section or step defined by dashed lines 203, dashed lines 205, and edges 205*a* and 205*b*, may have a length L2. The section between the dashed lines 213 and junction 207 may have a length L3. The length L4 of plate 204, between junction 207 and an end 204*a*. The length of post or pole 206 may be L6. The post or pole 206 may be substantially cylindrical and may have a diameter D2. The length, L5, of the handle 210 and the portion 210*b* of the handle 210 may have a diameter D3.

Each of the teeth 203*a-f* may protrude out from the dashed line 215 location of the plate 202 a distance of L7-L2. The distance or length form the end 209*b* to a tip of tooth 203*f* may be L7. Sections 202*a* and 202*b* may have a width W2. The teeth 203*a-f*, together may have a total width of W3.

Figure 8A:
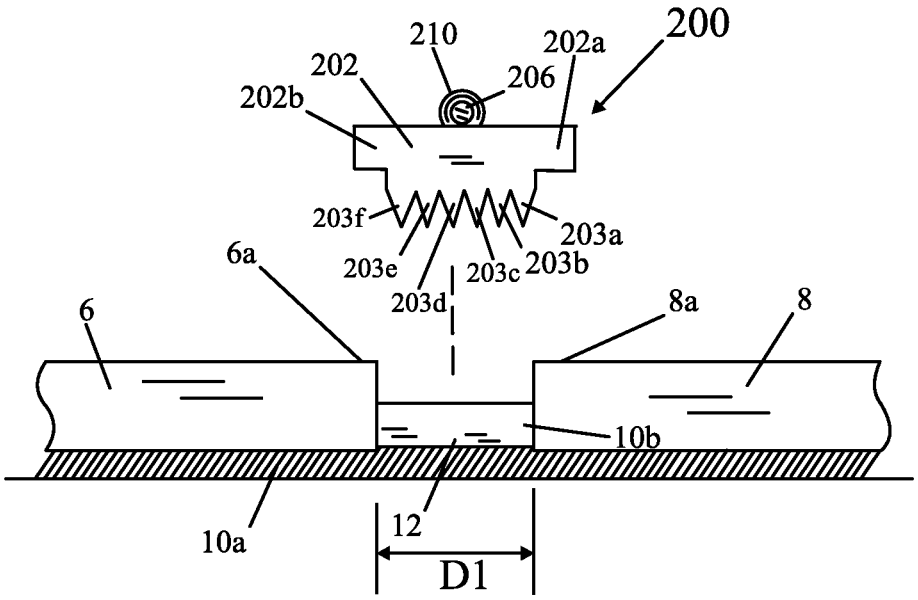
FIG. 8A shows a front view of the tool of FIG. 6 shown above stone sections and above fresh, non-dried glue in a gap between the stone sections.
Figure 8B:
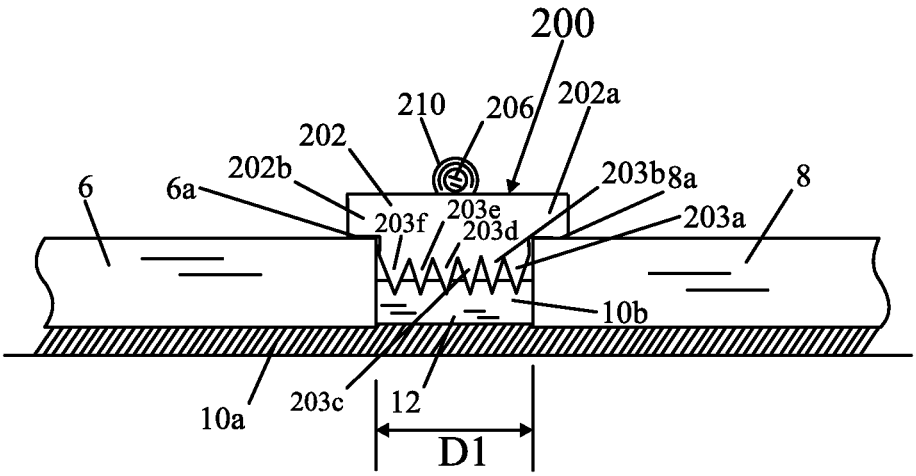
FIG. 8B shows a front view of the tool of FIG. 6 placed so that teeth of the tool are inserted in the fresh, non dried glue of FIG. 8A, and so the teeth can be used to comb the fresh, non-dried glue to create ridges.

FIG. 8A shows a front view of the tool 200 of FIG. 6 shown above stone sections 6 and 8 and above fresh, non-dried glue 10*b* in the gap 12 between the stone sections 6 and 8. FIG. 8B shows a front view of the tool 200 of FIG. 6 placed so that teeth 203*a-f* of the tool 200 are inserted in the fresh, non dried glue 10*b* of FIG. 8A, and so the teeth 203*a-f* can be used to comb the fresh, non-dried glue 10*b* to create ridges in the glue 10*b*. The tool 200 would be moved in a direction perpendicular to and into or out of the page for the FIG. 8B, in order to smooth out the glue 10*b* and create ridges for better adherence of the glue 10*b* to the tiles or chips 4. The tool 200 is placed in FIG. 8, so that the portions 202*b* and 202*a* of the tool 200, overlap and can rest on the portions 6*a* and 8*a* of the stone sections 6 and 8 and thereby prevent the teeth 203*a-f* from going any further into the glue 10*b*, then as shown in FIG. 8B. The width W3 of the teeth 203*a-f* together, shown in FIG. 6, is slightly less than the distance D1 of the gap 12, shown in FIGS. 8A and 8B. This allows for a snug fit of the tool 200 into the gap 12.

In at least one embodiment, the film 2 is typically clear or transparent. The film 2 could also be a thin sheet metal or other material in ridged sheet format. In a clear or transparent form for film 2, the film allows an installer to see the tiles or chips 4 and tile glue 10*b* through the film 2. The film 2 with chips 4 attached (which may be called a type of decorative trim), can be replaced by other formats, such as more rows of chips in different arrangements, or with chips 4 in different shapes or patterns. Each of the chips 4 (or decorative materials), may be made substantially or entirely of one or more of various materials such as glass chips, stone chips, ceramic chips, metal chips, etc.

The dimensions of the tool 200 may be different in other embodiments, and the dimensions given are merely examples of possible dimensions.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising configuring a rigid film so that the rigid film has a width larger than a gap defined between a first section and a second section which have been laid on a surface;

wherein the rigid film includes a top surface, a bottom surface, a first end, and a second end;

wherein the first end of the rigid film opposes the second end of the rigid film; and further comprising temporarily attaching a plurality of decorative pieces to the bottom surface of the rigid film by a releasable adhesive;

placing the rigid film so that the first end of the rigid film is supported by the first section, while simultaneously the second end of the rigid film is supported by the second section, and while simultaneously each of the plurality of decorative pieces is between the first section and the second section and is temporarily attached to and hangs from the bottom surface of the rigid film;

wherein each of the plurality of decorative pieces has a width which is smaller than the gap between the first section and the second section; and wherein the rigid film is sufficiently rigid so that the rigid film does not substantially sag when the first end of the rigid film is supported by the first section, while simultaneously the second end of the rigid film is supported by the second section, and while simultaneously each of the plurality of decorative pieces is between the first section and the second section and is temporarily attached to and hangs from the bottom surface of the rigid film the gap between the first section and the second section is formed by gluing the first section and the second section to the surface with a first glue; and further comprising gluing the plurality of decorative pieces, with a second glue, inside the gap between the first section and the second section.

2. The method of claim 1 further comprising after gluing the first section and the second section to the surface, allowing the first glue, used to glue the first section and the second section to the surface to dry before the step of gluing the plurality of decorative pieces inside the gap between the first section and the second section.

3. The method of claim 1 wherein the first section has a height, and the second section has a height;

wherein each of the plurality of decorative pieces has a height;

wherein the height of each of the plurality of decorative pieces is less than the height of the first section and less than the height of the second section;

and wherein the plurality of decorative pieces are glued inside of the gap between the first section and the second section so that a top surface of each of the plurality of decorative pieces is substantially level with a top surface of the first section and a top surface of a second section, and wherein the height of the first section, the height of the second section, and the height of each of the plurality of decorative pieces is perpendicular to the top surfaces of the first and second sections and the top surface of each of the plurality of decorative pieces.

4. The method of claim 1 further comprising peeling off the rigid film from the plurality of decorative pieces after the second glue has dried, so that the plurality of decorative pieces are fixed in the gap and are no longer attached to the rigid film.

5. The method of claim 1 wherein the first glue and the second glue are the same type of glue.

6. The method of claim 1 wherein the first glue and the second glue are different types of glue.

7. The method of claim 1 wherein the step of gluing the plurality of decorative pieces, with a second glue, inside the gap between the first section and the second section, includes applying the second glue inside the gap, and then raking the second glue with a plurality of teeth of a tool.

8. The method of claim 7 wherein the tool has two shoulder portions which engage portions of the first and second sections and which thereby prevent the teeth from penetrating farther than a certain distance into the gap.

9. The method of claim 1 wherein the rigid film is a rigid plastic film.

10. The method of claim 1 wherein the rigid film is a metal sheet.

11. The method of claim 1 wherein the rigid film is in the shape of an elongated strip having a length substantially greater than the width of the rigid film.

12. The method of claim 11 wherein the plurality of decorative pieces are arranged along the length of the rigid film in a single row.

13. The method of claim 11 wherein the plurality of decorative pieces are arranged in a matrix of a plurality of rows and a plurality of columns.

14. The method of claim 1 wherein each of the first section and the second section is made of stone.

15. The method of claim 1 wherein each of the first section and the second section is a tile section.

16. The method of claim 1 wherein the rigid film is transparent.

* * * * *